US007051397B2

(12) United States Patent
Smeja et al.

(10) Patent No.: US 7,051,397 B2
(45) Date of Patent: May 30, 2006

(54) MULTI-USE TOOL DEVICE, TOOL THEREFOR AND METHOD OF USING THE SAME

(75) Inventors: George Smeja, McHenry, IL (US); Michael V. Smeja, McHenry, IL (US); Troy Livingston, Northbrook, IL (US)

(73) Assignee: Master Products, Inc., McHenry, IL (US)

( * ) Notice: Subject to any disclaimer, the term of this patent is extended or adjusted under 35 U.S.C. 154(b) by 0 days.

(21) Appl. No.: 10/653,654

(22) Filed: Sep. 2, 2003

(65) Prior Publication Data

US 2004/0049873 A1 Mar. 18, 2004

Related U.S. Application Data

(60) Provisional application No. 60/411,813, filed on Sep. 18, 2002.

(51) Int. Cl.
*A47L 13/08* (2006.01)

(52) U.S. Cl. ..... 15/236.05; 15/236.08; 15/236.01; 15/145; 30/169

(58) Field of Classification Search ..... 15/236.01, 15/236.05, 236.08, 144.1, 145, 245.1, 235.8; 16/441, 430, 436; 403/34, 322.1; 30/169
See application file for complete search history.

(56) References Cited

U.S. PATENT DOCUMENTS 1,245,697 A * 11/1917 Frederick ..... 15/229.6
3,045,271 A * 7/1962 Cinotti ..... 15/235.8
3,434,175 A * 3/1969 Sidney ..... 15/105
5,467,498 A * 11/1995 Keegan et al. ..... 15/236.05
6,094,771 A * 8/2000 Egolf et al. ..... 15/210.1
6,745,427 B1 * 6/2004 Trenz et al. ..... 15/104.94

* cited by examiner

*Primary Examiner*—Richard Crispino
*Assistant Examiner*—Shay L. Balsis
(74) *Attorney, Agent, or Firm*—Fitch, Even, Tabin & Flannery

(57) ABSTRACT

A multi-use tool device is provided with an actuator that is moveable to turn a tool relative to the tool device to change the angle of attack of the tool to the work or to change to a different work surface on the fool. Further, the tool device is releasably connected to the tool without the use of threaded fasteners or wrenches. An actuator on the tool is moved to release the tool and preferably to push the tool from the tool device so that the user need not touch a dirty or spent tool that may be coated with an adhesive, mastic or the like. Conversely, the tool may be attached by pushing the tool relative to the tool device. Also, the preferred tool is made in one piece with a connecting portion and a turning portion thereon. The illustrated tool has an upstanding post and angularly spaced teeth that cooperate with the tool device to allow the connected tool to be turned relative to the tool body. In the preferred method of use of the tool, a common actuator in the form of a push button is pushed with a light force to turn the tool relative to the tool device and is pushed with a greater force to eject the tool from the tool device. The preferred tool is made inexpensively and in one piece. The tool device is lightweight and made mostly of inexpensive plastic parts. The tool device may have a body shaped to fit a person's hand or have a handle projecting therefrom for gripping by the user or to receive an extension pole.

26 Claims, 8 Drawing Sheets

MULTI-USE TOOL DEVICE, TOOL THEREFOR AND METHOD OF USING THE SAME

This application claims the benefit of U.S. Provisional Patent Application No. 60/411,813, filed: Sep. 18, 2002.

BACKGROUND OF THE INVENTION

This invention relates to a tool device having a body with a handle portion to be manually used by a user for typically spreading, scraping, sanding or the like with one of a number of detachable tools which may be desired to be turned to provide different edges or different working surfaces for use or to change the angle of the tool relative to the tool device. For example there is a multi-use spreader/stapler tool in the shape of a flat blade having three different edges, each with serrated teeth thereon which can be used for applying or spreading various materials, such as mastic adhesive, sealers, or the like. This flat blade tool itself is relatively inexpensive being made of one piece plastic and having a central opening therein by which it may be secured by a threaded fastener to a handle or the like for use. A wide range of various tools other than this flat blade disc can be provided and made more easy to operate and to be readily attached and detached to a multi-use tool device. The multi-use tool of this invention is not limited to any specific tool as it can be used with various tools other than the tools desired herein.

One problem with tools of the above-described type used for spreading mastic or adhesives is that they become quickly coated with the material, which may be sticky and which desired to be removed and disposed of with or cleaned from the tool at a later time without having the person using the tool getting his hands dirty with the material being moved by the tool. If the user's hands get covered with the material there is a chance to apply it to surfaces that are not to be coated or otherwise treated and there is a problem of cleaning one's hands so that the tool device having the handle being used is not also sticky and coated with the material.

Also, there is also a need for relatively inexpensive and simple lightweight handle tool devices which can be used with various types of tools and which can manipulate the tools and be releasably attached and detached thereto with a simple operation. For example, it is most desirable that the tool be attached to the tool device without having to use wrenches or threaded fasteners. Likewise, it is desirable that the tool be detached from the tool device without using wrenches for unthreading fasteners. Preferably the tool device as well as the tool are relatively inexpensive and adaptedly be produced in mass quantities for use in hardware stores, building supply stores, or the like, and for use not only by professionals but also by homeowners or the like.

SUMMARY OF THE INVENTION

In accordance with the present invention there is provided a new and improved multi-use tool device and tool for various tools such as spreading tools, scraping tools, sanding tools or the like and a new method of using the same. This is achieved by a simple tool device that has an actuator moveable to turn the tool to change the working edge of the tool or to change the attack angle for use of the tool such as for positioning the edge of a tool close to a wall so that one does not bang his knuckles against wall. Further, in accordance with the invention, a used, spent, or dirty tool can be removed without the user gripping the tool or otherwise having to unthread fasteners or use wrenches to release the tool from the tool device.

In accordance with another aspect of the invention, the tool device is made inexpensively and lightweight and is preferably made mainly of plastic molded parts. The preferred tool device has an actuator in the form of a push button which if pushed lightly turns the tool, for example through 45° or 90° to change the attack angle or through 90° to rotate a new edge into use. A harder push of the button causes the ejection of the tool from the tool case with a positive push-off force.

In the preferred embodiment of the tool device it is pressed down over the top of the preferred tool blade which has a projecting post thereon which snaps into the tool. This preferred tool device provides the ability to put on a tool very easily, to turn the tool to provide a new edge or angle of attack and to snap off a dirty tool without the user getting his hands messy from touching the tool.

In accordance with the preferred embodiment of the invention, the tool is easily snapped off by pushing an actuator on the tool device so that the dirty tool can be readily disposed of. Likewise it is preferred to make an easy attachment and a quick attachment of the tool to the tool device by merely pushing the tool onto the tool device.

In accordance with another aspect of the invention, it is preferred to provide an inexpensive, lightweight tool which is made in one or very few pieces and which has a connecting portion for connecting the tool to the tool device. Further, the tool is provided with turnable portions such as teeth which cooperate with the tool device to allow turning of the tool relative to the tool device to present a new working surface or edge or to change the angle of attack. The preferred tool may be inexpensively made in one piece by molding or may be stamped from metal.

In accordance with the present invention, there is provided a method of using a tool device and a tool adapted to be turned relative to the tool device and releasably connected to the tool device; the method comprising providing a manual handle portion on the tool device for manipulation by the user to present a first working surface or angle of attack on the tool to the work; providing a releasable, turnable tool for connection to the handle with multiple working surfaces thereon; moving an actuator on the tool device with a first movement of the actuator turning the tool to present another working surface or a second angle of attack; and moving an actuator with a second movement to release the tool from the tool device preferably by ejection. Preferably the method also involves the detaching of the tool by a snapping or pushing off of the tool so that one does not need to grip or grasp the dirty tool at the time of removal so that the user may keep his hands clean. In the preferred method, it is preferred to attach a tool merely by putting the tool device over the tool and pushing the tool device relative to the tool to clamp the tool onto the tool device.

Further and in accordance with another aspect of the method, the actuator may be in the form of a push button and the method may involve pushing the push button with a first light force to cause a movement of the tool in an angular direction with respect to the tool device and with a second greater force to eject the tool from the tool device.

DETAILED DESCRIPTION OF THE PREFERRED EMBODIMENT

Figure 1:
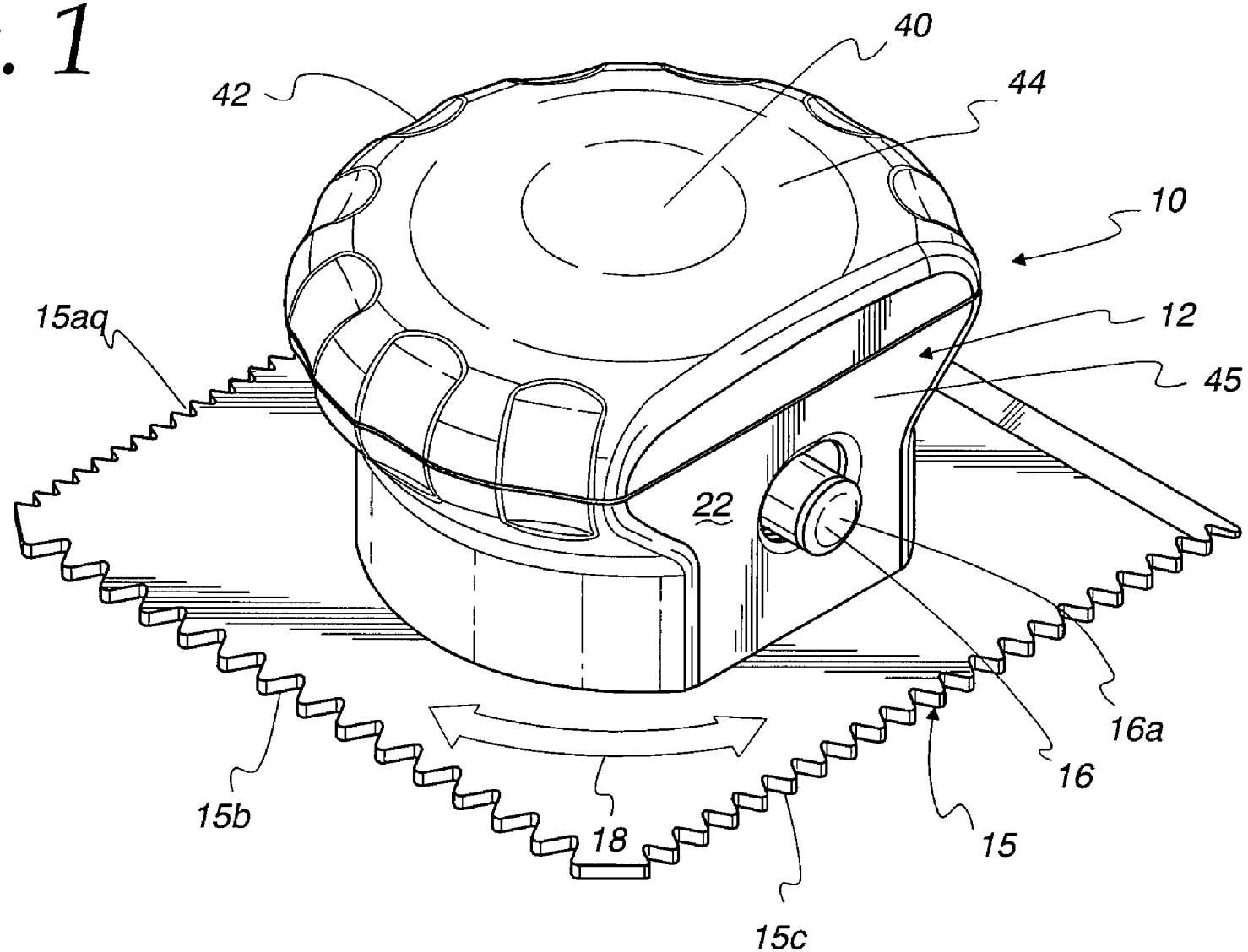
FIG. 1 is a perspective view of a tool device and tool constructed in accordance with the preferred embodiment of the invention.

As shown in the drawings for purposes of illustration, there is provided a tool device 10 having a handle 12 for gripping and use by the user with respect to a releasably detachable tool 14 which has one or more working surfaces 15. In the tool shown in FIG. 1, the tool is provided with three working surfaces 15*aq*, 15*b* and 15*c* which are located on the edges of the tool so as to provide a different size and/or spacing of teeth along the respective edges of the tool. It is to be understood that the working surfaces for various tools may not be on the edge, as shown in FIG. 1, and may be located elsewhere on the tool.

Figure 2:
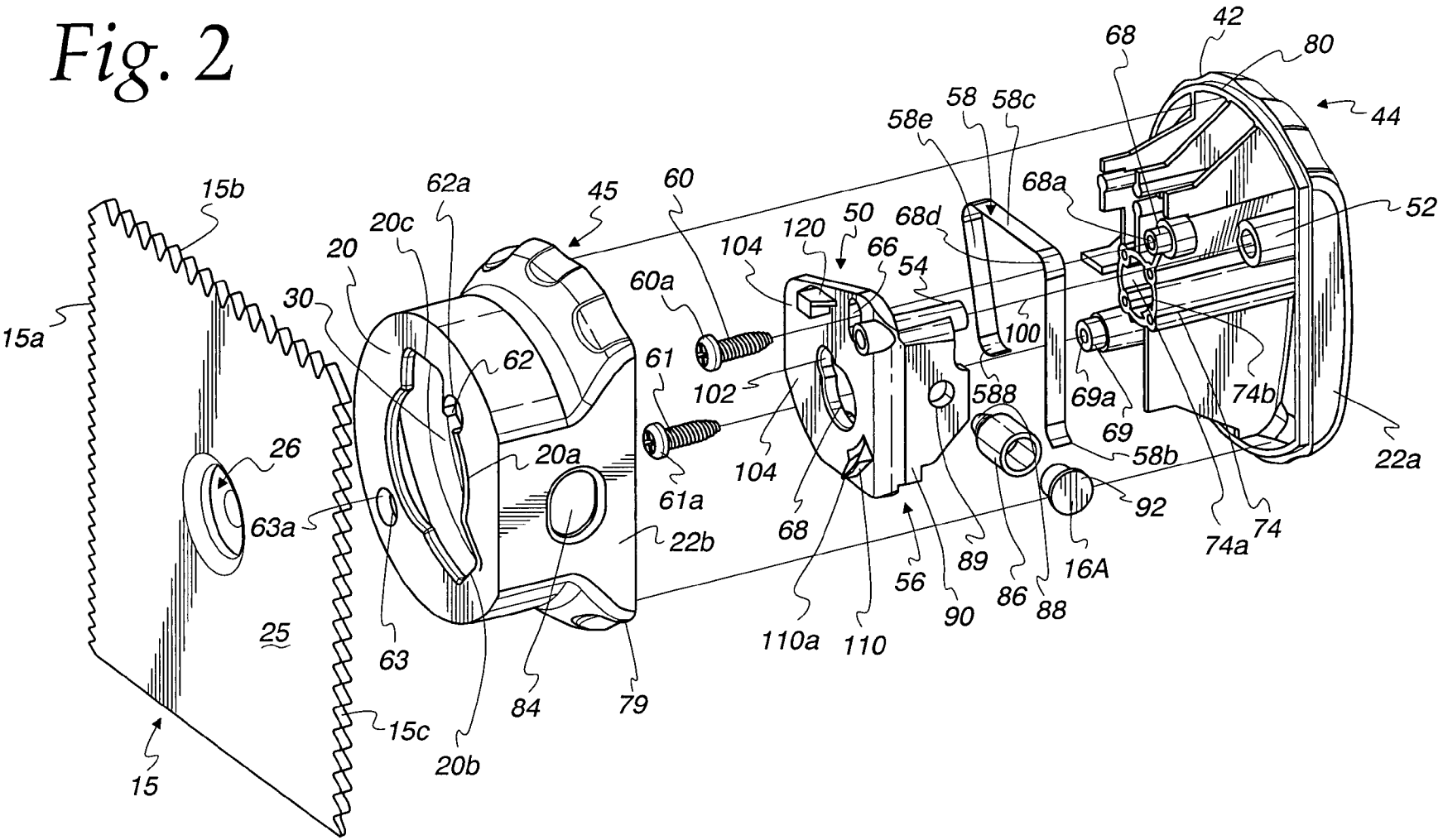
FIG. 2 is a exploded view of the tool and the tool device of FIG. 1.
Figure 3:
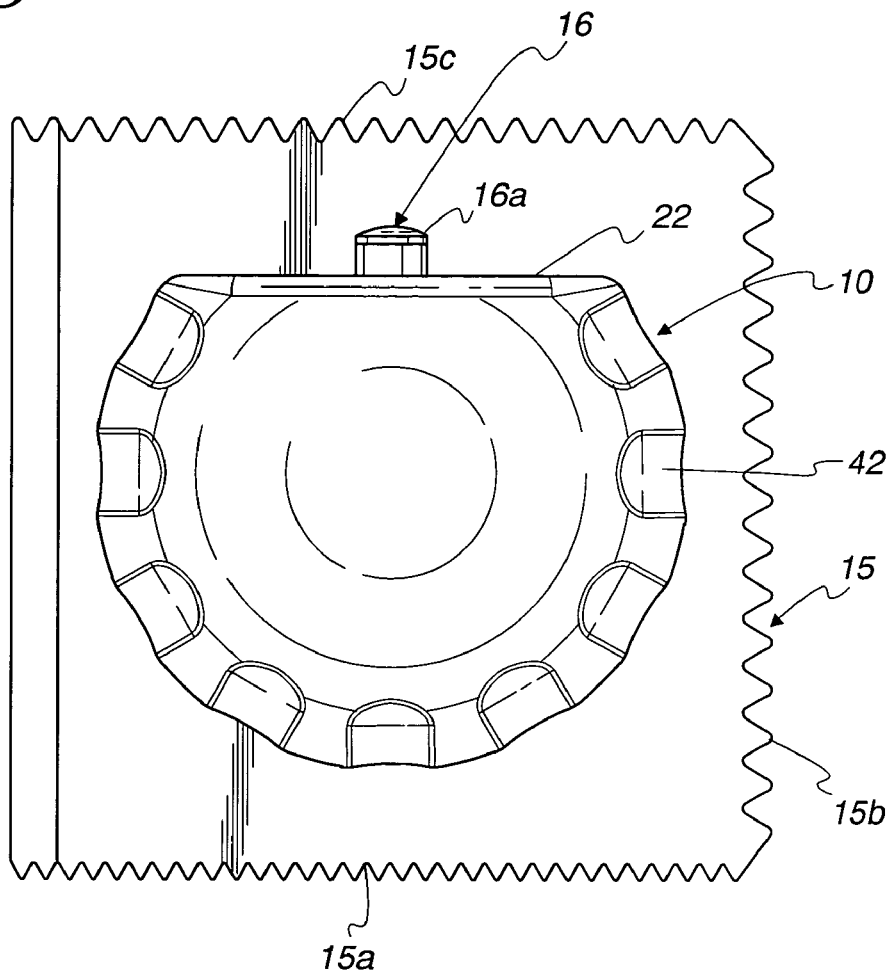
FIG. 3 is a plan view of the tool and tool device shown in FIG. 1.
Figure 4:
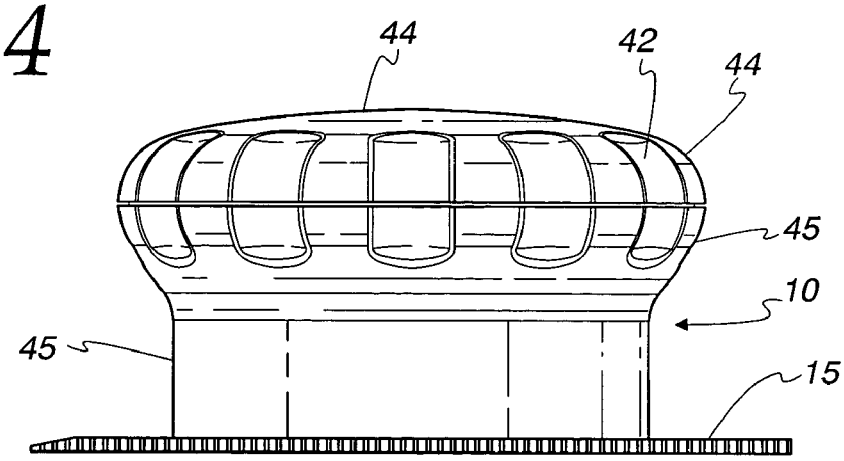
FIG. 4 is a side elevational view of the tool and tool device shown in FIG. 1.

In accordance with the present invention, the tool 14 may be rotated or turned relative to the tool device 10 and handle 12 by operation of an actuator 16 which will turn the tool in the direction shown by the directional arrow 18 in FIG. 1 to present a new working surface or a new angle of attack. Herein, the actuator 16 may also be used to eject the tool or to snap the tool off by pushing it off from a bottom end 20 of the tool as shown in FIGS. 1 and 2 so that the tool is spaced therefrom such as shown in FIG. 2. Thus, a person need not touch the tool, particularly if it is coated with an adhesive or mastic or other material which would dirty the hands of the user, or for other reasons need not be touched. The used tool may be deposited in a magazine or the like, as will be explained hereinafter.

In accordance with an important aspect of the invention, it is preferred to provide a push button type of actuator 16 having a push button 16*a* which is pushed in relative to a flat side 22 on the palm handle such that a slight pressure and short movement of the push button results in the turning of the tool relative to the handle 12 as shown by the directional arrow 18 through predetermined increments of turning, e.g., through 45° increments of turning. Usually a 45° increment will allow a different angle of attack for the tool edge or working surface to be positioned close to a wall or into a different spot. To provide a new tool edge, such as the tool edge 15*b*, the push button is pushed twice to provide two 45° increments of travel so that the edge 15*b* will then be in the location of the edge 15*aq* in FIG. 1 and spaced opposite the flat side 22 of the handle 12. Manifestly, the amount of turning movement of the tool relative to the tool device may be varied from the 45° and 90° increments described herein by way of example only. Indeed, the tools may take various forms and shapes from that illustrated herein and the tool may be triangular in shape or elongated rather than generally square-shaped as shown in the views in this preferred embodiment of the invention.

Figure 17:
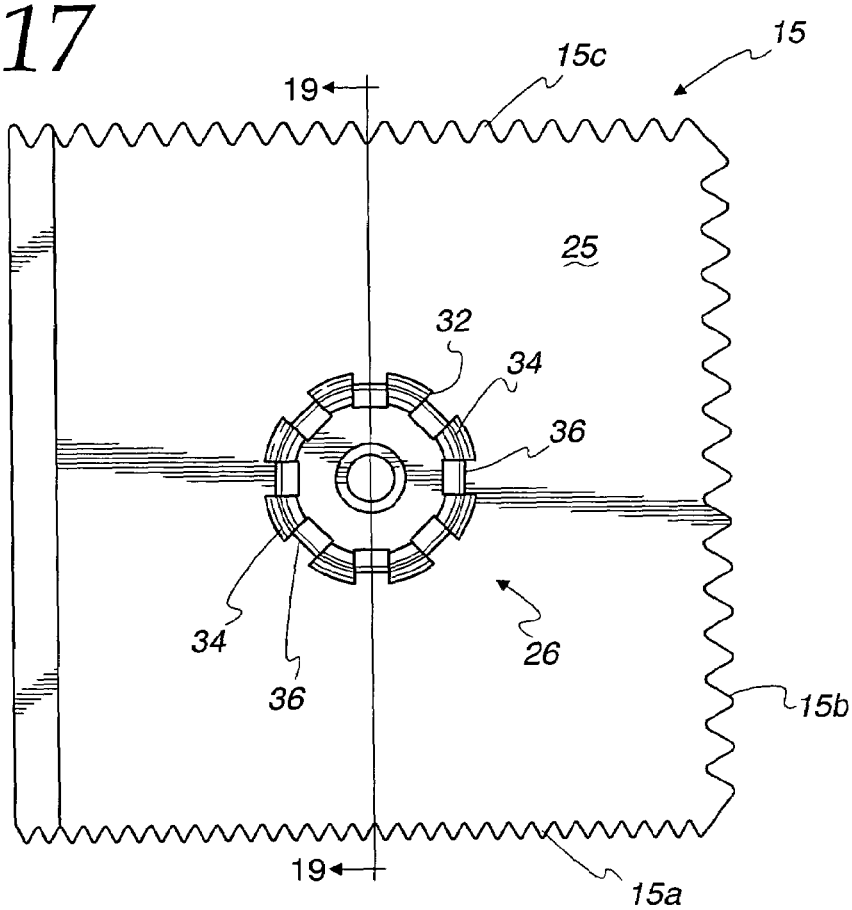
FIG. 17 is a plan view of one tool usable with the tool device of FIG. 1.
Figure 18:
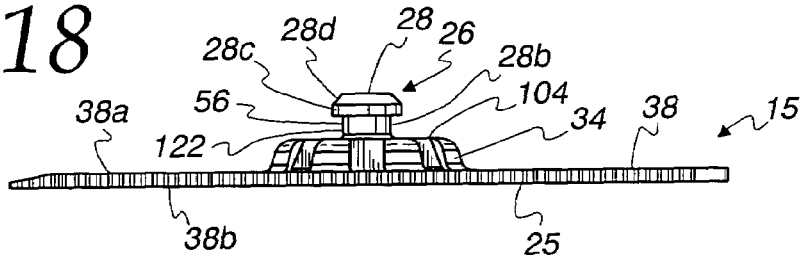
FIG. 18 is a side elevational view of the tool of FIG. 17.

For the purpose of ejecting the tool, the push button 16*a* may be pushed inwardly by a substantially greater degree of movement and with a greater force to cause a camming or ejecting of the tool away from the bottom flat face 20 of the tool device 10 to a position such as shown in FIG. 2 where the tool is spaced from the tool device 10. It should be appreciated that the tools usable with the tool device 10 may represent a considerable and volume of sales and require features that make them usable with the tool device such as to allow the turning of the tool with operation of the actuator 16 and also to allow removal of the tool with the operation of the actuator. Preferably the tool is also readily attached to the tool device 10 by simple pushing of the tool device onto the tool. To this end, the tool 15 illustrated in FIGS. 17 to 19 comprises a body 25 having a releasable retention portion 26 for connection to the handle device and herein the preferred retention portion 26 comprises an upstanding post or male part 28 to be fitted into a hollow receiving portion 30 (FIG. 2) on the tool device 10. To facilitate turning of the tool body 25 relative to the handle device 10 with operation of the actuator 16, it is preferred to provide a plurality of turning portions 32 such as in the form of spaced teeth 34, as shown in FIGS. 17 and 18 adjacent the upstanding post 28. Herein there are eight such teeth 34 which are spaced apart by spaces 36 and which cooperate with the handle device to turn the tool body 25 through 45° increments of turning movement with each operation of the actuator push button 16*a* through a turning stroke.

Figure 19:
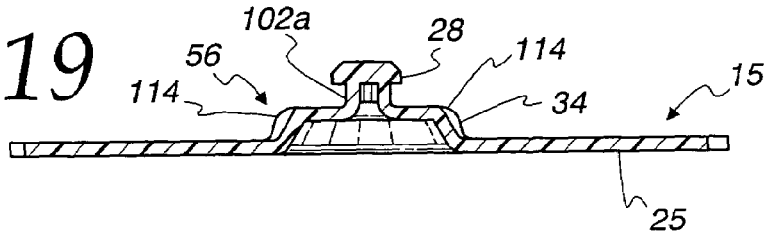
FIG. 19 is a cross-sectional view taken substantially along the Line 19—19 in FIG. 17.

In accordance with the preferred embodiment of the invention, the tool 15 is made in one piece and of molded plastic including the integral, upstanding, inner connection post 28 as well as the teeth 34 which are integral with the body 25. The illustrated tool has a flat plate-shaped tool portion having a top substantially planar surface 38*a* and a parallel lower flat planar surface 38*b* with the central post 28 and centrally located teeth 34 being projecting upwardly at the center of flat plate body 25, as shown in FIGS. 18 and 19. In the tool illustrated in FIG. 17 the respective working surfaces 15*aq*, 15*b* and 15*c* are serrated teeth of various sizes and shapes. It is to be understood that the invention is not limited to this particular flat disc or plate tool, but is intended that the tool device be used with various other types of tools. For instance, the tool may have a sanding surface thereon or may have other types of spreading surfaces thereon for handling various materials and substances. Further it would be appreciated that the preferred tool shown in FIGS. 17–19 can likewise be made of stamped metal rather than molded plastic to provide a one piece tool of inexpensive manufacture. Also, the tool 15 may be made of multiple pieces, rather than a single piece for various other types of tools from that illustrated in these drawings and still fall within the purview of the invention. This invention is not limited to a specific tool illustrated and described hereon which is done by way of example only and not by way of limitation as to any particular tool.

The handle shown in FIG. 1 is a palm-shaped handle which can be fitted into the palm of the hand being located over a circular top 40 of the handle 12 and with finger grooves 42 being located along the circumferential edges of the handle adjacent an upper portion 44 of the handle. The upper portion 44 of the handle 12 is shown in exploded view 2 as being mateable with a lower portion 45 of the handle within which is located the retention and turning mechanism 50. The flat side 22 with the handle orients handle for gripping with the rear of the user's palm being at the flat side 22. The palm-shaped handle is readily gripped with the fingers and thumb gripping in the grooves 42 so that the hand does not fatigue and does not slip on the handle when gripping the same, particularly if the user's hand becomes sweaty. In many instances the user may want to turn the orientation of the tool relative to the handle if the person becomes tired or fatigued and wants and to change the angle of the handle. In some instances the angle of attack close to a wall or the like is more readily used when the tool is rotated through 45° so that the edges are at 45' rather than having two edges parallel to the flat side 22 of the handle. Also when near the edge of a roof or other place for spreading adhesive or tar-like substance, the angle at 45° may work well and keep the hand away from the edge.

Figure 5:
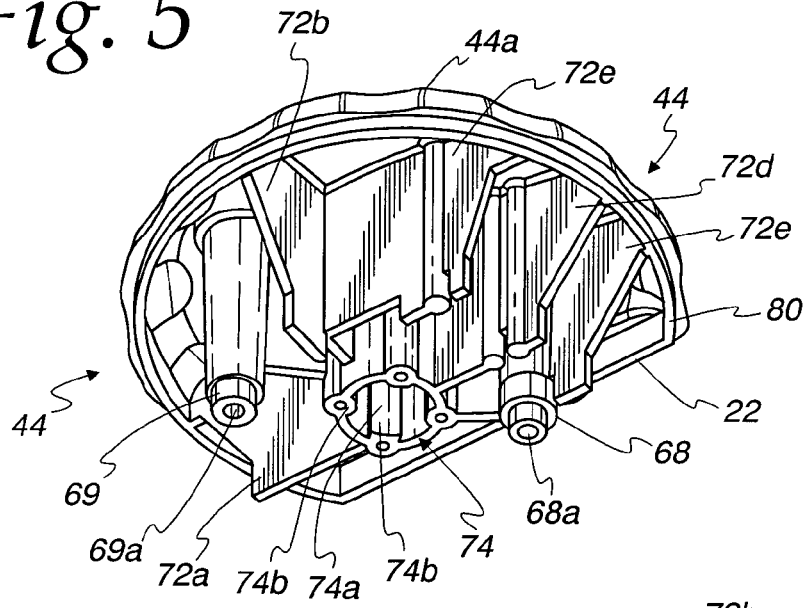
FIG. 5 is a perspective view of the top portion of a palm handle for the tool device.
Figure 6:
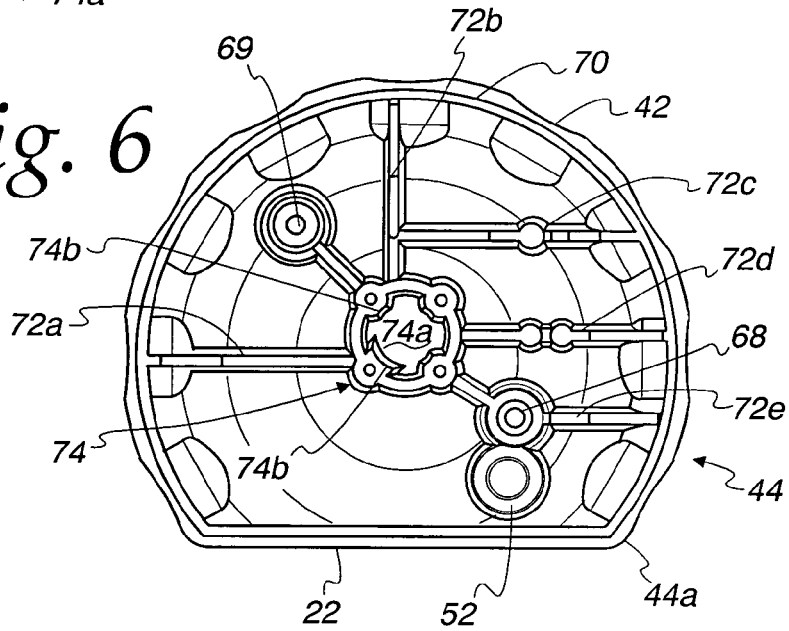
FIG. 6 is a bottom view of the palm handle top portion shown in FIG. 5.
Figure 7:
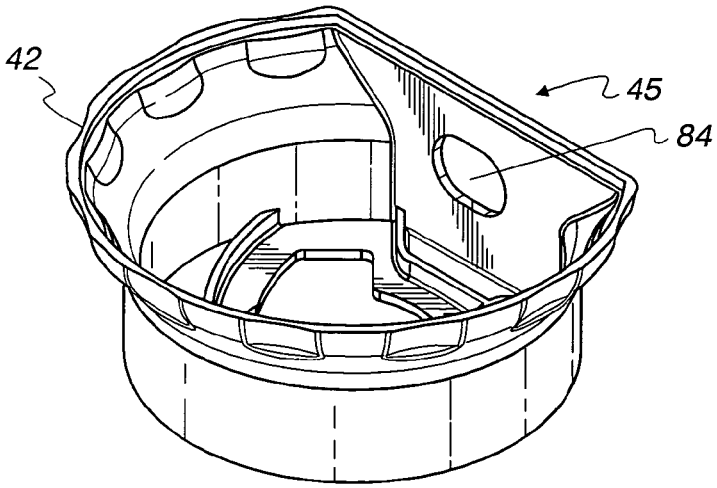
FIG. 7 is a perspective view of the palm cover bottom portion for use with the top portions shown in FIGS. 5 and 6.

Referring now in greater detail to the preferred and illustrated pieces which comprise the tool device 10, the top cover portion 44 as best seen in FIGS. 2, 5 and 6 is provided with a one piece molded plastic body 44*a* which has a downwardly projecting post 52 on which is pivotally mounted the cam turning/retention device 50, which is pivotally mounted for turning movement with operation of the push button actuator 16. Herein the turning and retention device will hereinafter be called a cam 56. The cam 56 is biased to its tool retention position by a one piece spring 58, which performs multiple functions and is located within the handle 12 (FIG. 2). As will be explained in greater detail, the moveable cam is also operated by the push button actuator to turn the tool and to push the tool from the tool device.

Figure 8:
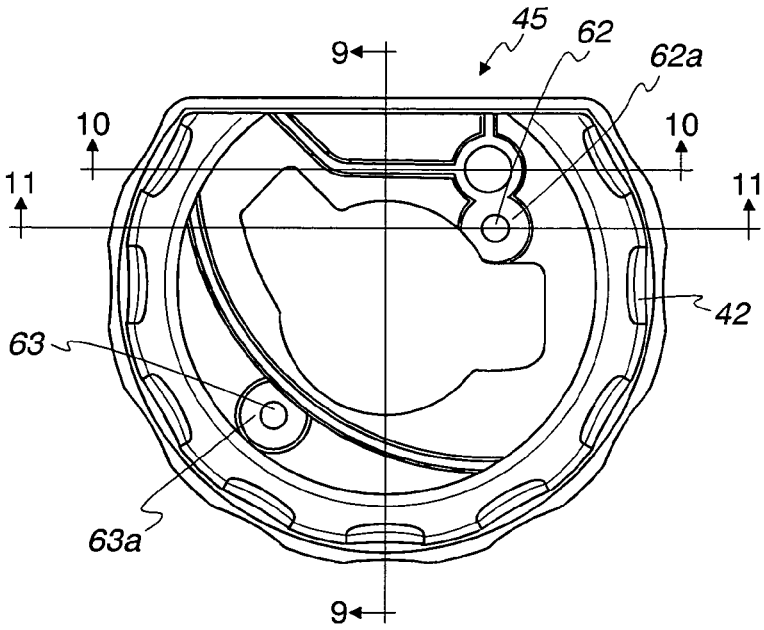
FIG. 8 is a bottom view of the palm cover bottom portion shown in FIG. 7.
Figure 9:
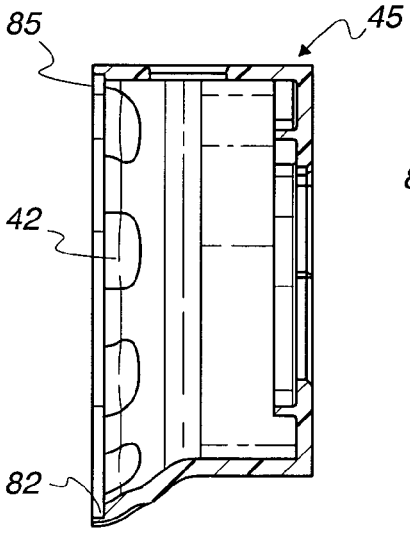
FIG. 9 is a sectional view taken along the Line 9—9 of FIG. 8.
Figure 10:
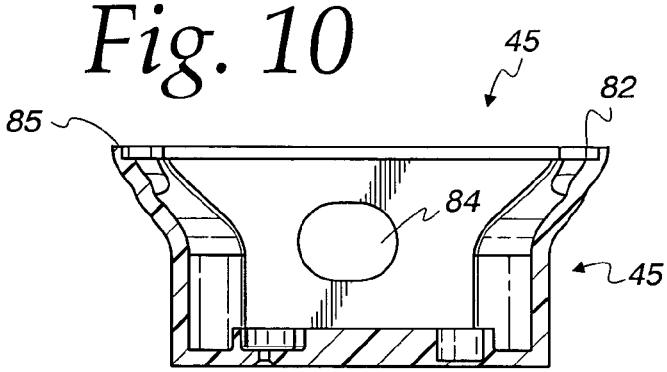
FIG. 10 is a cross-sectional view taken along the Line 10—10 of FIG. 8.

In this preferred embodiment of the invention as best seen in FIG. 2, the handle also includes the lower handle portion 45 which is secured by fasteners 60 and 61 inserted through holes or openings 62 and 63 at the bottom of the cover as seen in FIGS. 2 and 10. Shanks of the screws pass through elongated openings or holes 66 and 68 in the cam member 56 without interfering with the pivoting of the cam 56 about an axis through the center of the pivoting post 54 (FIG. 13) in the cam and through the center of the aligned receiving post 52 on the top cover 44. The bottom cover 45 is secured to the to cover portion 44 by the screws 60 and 61 which have enlarged heads 60*a* and 61*a* which are seated respectively within enlarged seats 62*a* and 63*a* (FIG. 8) opening into the bottom surface of the lower handle portion 45. The distal, upper threaded ends of the fasteners 60 and 61 extend through the enlarged openings 66 and 65 in the cam 56 and are threaded into respective posts 68 and 69 in the top portion 44. The posts 68 and 69 have bores 69*a* and 68*a* to receive the threaded ends of the screws which are threaded into the posts in order to connect the two core halves 44 and 45 together.

As best seen in FIGS. 2, 5, 6 and 7, the top cover portion 44 is a one piece molded plastic with an outer shell 70, which is generally in the shape of a dome with the finger grooves 42 therein on the outer side of the shall 70. Integrally molded in the interior of the shell 70 are a series of downwardly projecting strengthening ribs 72*a*–72*e* which have their upper ends integrally connected to the shell 70 of the cover portion 44. The respective, radially inner ends of the respective ribs 72*a*–72*e* are connected directly of indirectly to a central retention member or retention post 74 of generally circular configuration as best seen in FIGS. 5 and 6. Radially outer ends of the respective ribs 72*a*–72*e* are connected to the shell wall 70 to provide a rigid strong construction for the handle.

Figure 11:
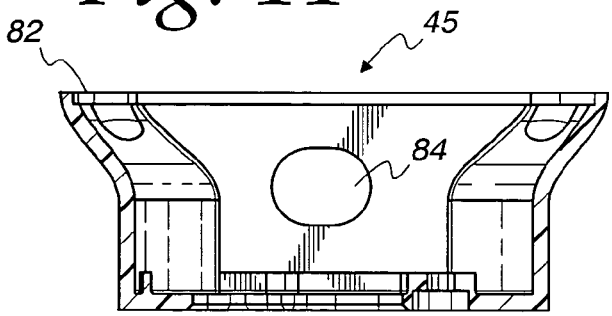
FIG. 11 is a cross-sectional view taken along the Line 11—11 of FIG. 8.

Herein, the upper portion 44 has a shorter height than the height of the lower portion 45. The two portions 44 and 45 are nested at a parting line therebetween. More specifically, a downwardly internal projecting rim 80, FIG. 5 on the top portion 44 is sized and positioned to be seated within a peripheral groove 82, as best seen in FIGS. 10 and 11. The mating or parting line between the upper and lower handle portions is defined by an annular end wall 81 on the top portion abutting an upper, outer shoulder 85 on the lower portion.

The flat side 22 of the palm-shaped handle is comprised of a first or upper flat side portion 22*a* on the top portion 44 which meets with and is co-planar with the flat side portion 22*b* on the lower cover portion 45. The push button actuator is received within an elongated opening 84 in the flat portion 22*b* on the lower cover.

Figure 20:
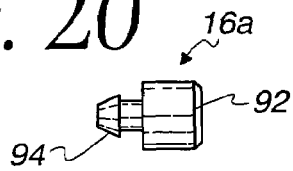
FIG. 20 is a first side elevational view of a push button usable with the tool device shown in FIG. 1.
Figure 21:
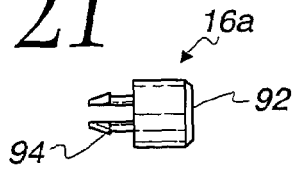
FIG. 21 is a bottom view of the button shown in FIG. 20.

As best seen in FIG. 2 and in FIGS. 20 and 21, the illustrated push button actuator 16*a* comprises a first inner piece 86 which has an internal threaded portion 88 for threading into a hole 89 in a wall 90 of the cam 56. The push button has a threaded bore 92 into which is snap fitted a push button end cap 92. The preferred connection between the portion of the push button 86 and the end cap 92 is by a pair of spring biased detent portions 94 which are inserted within the internal bore 82 and the fixed portion to connect the two pieces to form the push button 16*a*. This push button actuator is located in the opening 84 and is provided to swing the cam 56 about an axis 100 (FIG. 2) through the center of the post 54 on the cam and the center of the pivot post 52 on the top cover portion 44. That is the pushing of the push button inwardly will cause the cam to pivot about the axis 100 relative to both the top cover portion 44 and the lower cover portion 45 which are held stationary and together by the two screws 60 and 61. As will be explained in greater detail hereinafter, a light pressure and a small movement of the cam 50 by pushing on the push button will cause the rotation of the tool through a predetermined increment such as 45° whereas a full pushing of the push button with a greater pressure and stroke causes a larger pivotal movement and causes an ejection of the tool from the tool device.

In the illustrated embodiment of the invention, the tool is retained on the tool device when the male upstanding post 28 on the tool 14 as best shown in FIGS. 18 and 19 is positioned to project through the opening 68 in the cam 56 and to project an enlarged head 28*a* on the post 28 into the internal central hollow post 74 of the upper cap portion 45. To this end it is preferred that the post 28 on the tool 14 have its enlarged shouldered head have a narrow neck portion 28*b* beneath a retention larger diameter shoulder 28*c* at the bottom of the head 28*a*. Inclined camming surfaces 28*d* are provided on the vertical sides of the post 28 to cam the cam 56, when the tool is positioned over and pushed downwardly, to allow the enlarged head to move through the enlarged opening 68 in the cam and upwardly into the hollow interior of the hollow post 74 to connect the tool 14 to the tool device 10. Herein, the tool connecting post 28 extends significantly upwardly that it projects through the opening 68 in the cam 56 to position its head portion 28*c* above the cam portion 56, as best seen and illustrated by dotted lines in FIG. 18. The head portion also projects upwardly into the hollow bore. When the post 28 on the tool 14 is positioned within the tool device, the post is captured by wall 102 on the cam 56 at a small opening 103 formed as part of the larger opening 68 in a flat portion 104 of the locking lever cam 56.

As best shown by phantom lines in FIGS. 18 and 19, the wall 102 of the cam 56 extends under the shoulder wall 28*c* of the post 28 and is positioned to rest on the top end surface 114 at the top of the teeth 34. The spring 58 biases the small opening 103 and its end wall 102 into this capturing position in which the top head portion 28*b* of the post is positioned within the hollow bore 74*a* of the large post 74 in the upper handle portion 44. More specifically the spring 58 rotates the cam 56 in a counter-clockwise direction as seen in FIG. 2 causing the shoulder wall 102 to be within the neck portion 28*b* on the post 28 and under the head 28*c* and pushing the head of the post against a sidewall within the central post 74 in the top portion 44. Because the bottom of the post head portion 28*c* rests on the top of the wall 102 of locking lever cam 56, the tool post 28 and the tool cannot be pulled directly from the tool device through the opening in the bottom portion. The spring 58 acting on the locking lever cam 56 pushes its wall 102 in the clockwise direction on the neck 28*b* of the tool post 28 forcing the opposite upper side or shoulder 28*c* of the post head against inside spaced arcuate wall portions 74*b* on the hollow retention post 74. That is, the head of the post is positioned with the hollow post substantially on the axis of the hollow bore 74*a* of the retention post 74 with shoulder 28*c* of the post head 28*a* pushed against the arcuate and axially extending surface 74*b* in the bore 74 by the spring 58. The spring pushes the locking lever wall 102 tight against the neck 28*b* of the post 28.

To release the post for removal, the push button 16*a* is pushed to push the locking lever locking lever cam 53 to swing about the axis 100 against the urging of the spring 58 to position the large diameter portion of the opening 68 in alignment with the post 28 so that the post's neck 28*b* is no longer captured or held by the wall 102 in the small diameter opening 103.

Figure 12:
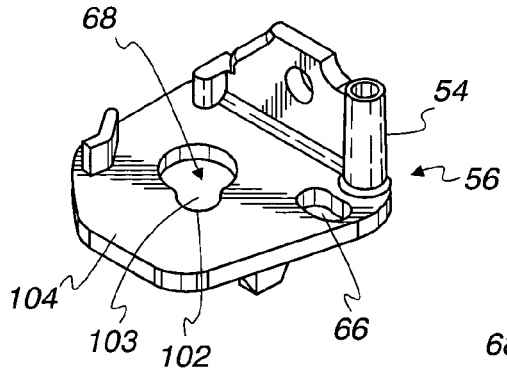
FIG. 12 is a perspective view of a cam mounted within the palm cover.

To bias the locking lever cam 56 to its retention position to retain the tool and to allow replacement of a tool with pivoting of the locking lever cam, the spring 58 is preferably formed inexpensively of one piece and easily assembled within the tool device. Further, the illustrated spring 58 also serves to bias the push button actuator outwardly of the lower cover portion 45 and in position to resist the inward manual pressure during actuation of the push button against the spring force. To this latter end, a leaf spring leg 58*a* (FIG. 2) on the spring 58 has a distal end 58*b* positioned or tacked to the bush button 16*a*. A central portion 58*c* of the spring 58 is positioned on the upper cover portion 25 with a curved portion 58*d* of the spring positioned about the outer side of the post 68. Another leaf spring biasing leg 58*e* has a curved end 58*f* that is engaging the locking lever cam 56 at a integral, bent projection 56*a* (FIG. 12) projecting from the flat plate portion 104 of the locking lever cam 56. The leaf spring leg 58*e* biases the locking to turn in the counterclockwise (FIG. 2) locking direction, as seen in FIG. 2. That is, the spring biases the locking lever cam 56 to bring wall 102*a* thereon against the neck 28*b* of the connecting post 28 on the tool 15 and force the wall 28*c* of the head against interior post wall portions 74*b* (FIGS. 2, 5 and 6) of the post 74. Manifestly, the illustrated spring may be replaced by other shapes or kinds of springs and by multiple springs rather than the illustrated spring 58, which provides a low cost biasing means that is easily assembled in the tool device to perform multiple functions.

Figure 13:
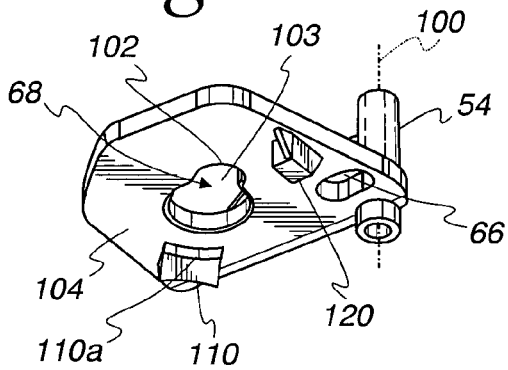
FIG. 13 is a bottom perspective view of the cam shown in FIG. 12.
Figure 14:
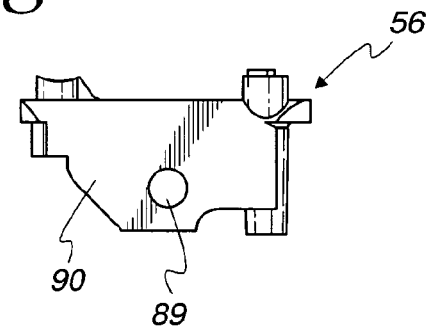
FIG. 14 is a side elevational view of the cam shown in FIG. 12.
Figure 15:
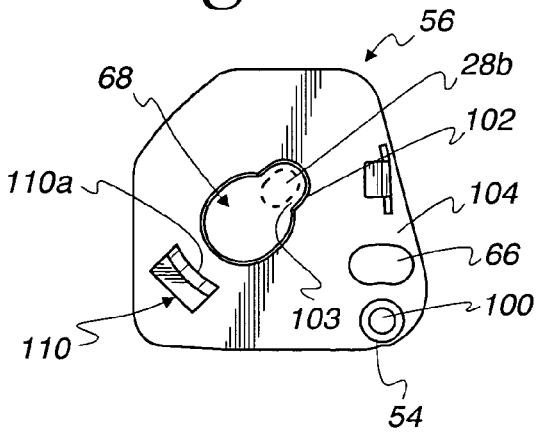
FIG. 15 is a bottom view of the cam of FIG. 12.
Figure 16:
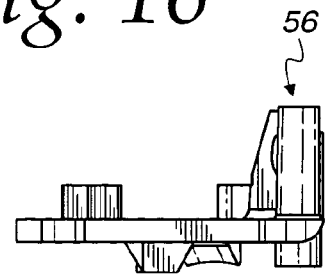
FIG. 16 is a side elevational view looking at the right side of the cam in FIG. 15.

Herein the tool 14 is pushed or snapped off the bottom face 20 of the tool device 10 by an ejection cam 110 which is located on and is projecting downwardly from the lower face of the cam plate 104 as best seen in FIGS. 2, 13 and 15. More specifically the ejection cam 110 has an inclined camming surface 110*a* to push off the tool when swinging against a portion of the tool. A pushing of the push button will swing the cam 56 and to space the wall 102 from the neck 28*b* on the post 28 and to position the large opening 68 over the post 28. Simultaneously, the inclined surface 110*a* on the cam 120 will be engaging and pushing on rounded camming surfaces 114, as best seen in FIG. 19, to eject the tool with the post 28 passing the aligned opening 68 and from the tool device 10. Thus, it will be seen that there is a positive ejecting action from the inclined cam surface 110*a* against the rounded inclined shoulder surface 104 at the top of the teeth 34 on the tool. Preferably, the cam surface 110 pushes the tool from the tool device so that the user need not grip a dirty tool, or a tool that is otherwise coated or contaminated with, the material that is being spread. The release of the push button from its ejection position, the spring 58 returns the cam 56 to the position shown in FIGS. 2, 13 and 15 where the small opening 103 will be positioned over the center axis of the opening 30 in the bottom portion.

When the new tool is positioned centrally, the incline surfaces 28*d* on the post 28 will cam against the side walls 102 of the small opening 103 swinging the cam 56 in the counter-clockwise direction against the spring force on the spring allowing the big opening and the head of the post 28 to move upwardly into the receiving bore of the central post on the top cover portion 44. When the enlarged head passes the top of the cam plate 44, the spring 58 causes the camming plate to move in a counterclockwise direction as seen in FIG. 15 to bring the wall 102 back against the neck portion 28*b* of the post so that the cam plate is positioned under the large head and shoulder 28*c* on the post 28 thereby capturing the new tool which has been inserted by merely pressing down of the tool onto the post 28.

To turn the tool 15 through a predetermined amount of turning, for example 45° with a slight inward movement and lesser pressure of the push button, the camming plate 104 is provided with another cam or projection 120 which cooperates with the indexing teeth 32 on the tool. The inward positioning movement of the cam plate causes the cam 120 to engage a tooth 32 and to rotate the tool through 45° and release of the spring allows the cam plate to return to the position desired without any further operation needed. If it is desired to put a new working edge 15*a*, 15*b* or 15*c* into position rather than change the attack angle, the push button is pressed again and to turn the tool for another 15°. The flat planar body 25 of the tool 15 is pressed against the flat bottom 20 of the lower handle portion 45 to provide a large stable area of contact and support between the tool 15 and the tool device 10. Also, this bottom end 20 of the lower cover portion 45 has an opening 20*a* therein that admits the tool post 28 and the teeth 34 about the post. The opening 20*a* is generally circular with cut-out enlargements 20*b* into which projects the cam 110 on the locking lever cam 56. The opening 20*a* has another cutout enlargement 20*c* into which project the other cam 120 that engages the teeth 34 on the tool 15 to turn it.

Figure 22:
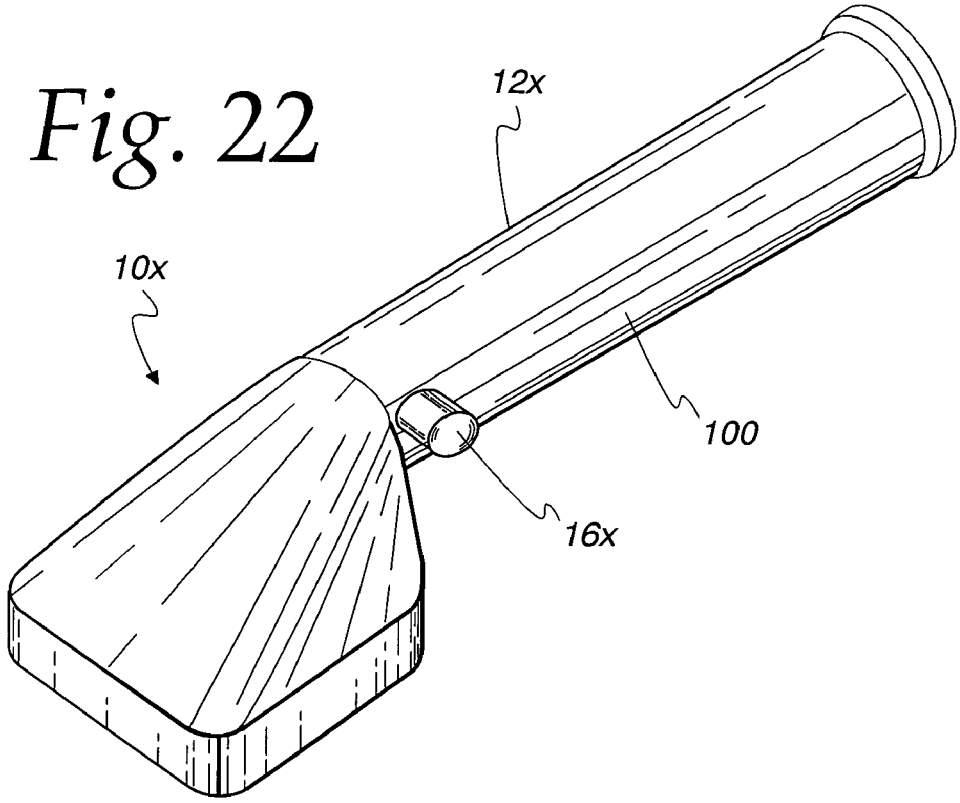
FIG. 22 is a perspective view of another embodiment having a long handle.
Figure 23:
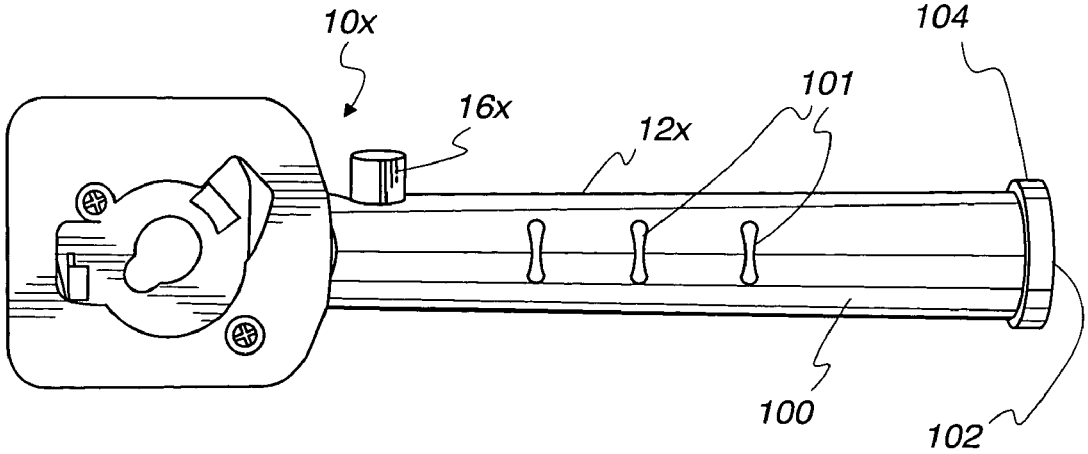
FIG. 23 is a bottom view of the embodiment of FIG. 22.

In accordance with a further embodiment, which is illustrated in FIGS. 22 and 23, the tool device 10X is provided with a long handle 12X rather than the short palm handle 12 described above. In the long handled tool the user may grip a generally cylindrically shaped outer handle body 100 which projects outwardly from the upper portion 44 which has the lower portion 45 joined thereto for the tool device 10X. The tool may be rotated by operation of an actuator push button 16X which is located in the handle body and performs the same functions and operations in the same manner as described above for the push button actuator 16. Thus, the push button 16X may be pushed to eject the tool from the bottom end of the tool device 10X with a greater inward push of the actuator push button than is used to turn the tool to present a new edge. Within the tool device 10X, there is the same releasable retention device for retaining and for ejecting the tool as used in the first described embodiment of FIGS. 1–21. Likewise, the same turning mechanism is disposed in the tool device body to turn the tool as is used in the first described embodiment.

The handle body 100 (FIGS. 20 and 22) is made to be gripped by the tool user's hand and to this end may have spaced finger grip projections 101 on the underside of the handle as shown in FIG. 23. The actuator push button 16 is positioned on the side of the handle body to be in alignment with the user's thumb which may be used to push the actuator button 16X while gripping the long handle body.

The handle body 100 is preferably hollow and tubular with a hollow end 102 to receive the end of a long wooden or plastic broom type entering handle or pole that may be inserted into the hollow end 102. The handle body 100 may be slightly tapered as is the interior hollow bore that receives the extension handle that is pushed into the tool device's handle to have a wedge and friction fit therewith. Thus, the user may stand while using the extension handle fitted into the hollow end of the tool device 10X.

What is claimed is:

1. A tool device for a detachable working tool capable of being turned about a turning axis on the working tool to change to a different working surface, the tool device comprising:

a body adapted to be held by the user when using the tool;

a releasable retention device in the body for retaining the tool on the body and for releasing the tool from the body;

a turning mechanism in the body having a portion movable to force the tool to turn and reposition the tool about the turning axis to change a different working surface; and an actuator on the body movable to a first position to actuate the portion of the turning mechanism to force the tool to turn about the turning axis and relative to the body and movable to a second position to actuate the releasable retention device for releasing the tool from the body.

2. A tool device in accordance with claim 1 wherein the actuator comprises:

a push portion on the actuator for being pushed by the user with a lighter pressure to allow turning of the tool relative to the body and being capable of being pushed with a greater pressure to cause a release of the tool from the body.

3. A tool device in accordance with claim 1 wherein the body has a flat bottom surface and wherein the tool is a flat planar blade having multiple edges for turning into a use position.

4. A tool device in accordance with claim 1 wherein the actuator has a release portion for actuating the releasable retention device to push the tool from the body so that the tool is removed without a person having to touch the tool.

5. A tool device in accordance with claim 1 wherein the releasable retention device comprises a movable clamping portion movable relative to the tool when pushing down over the tool to cause a clamping of the tool to the body.

6. A tool device in accordance with claim 5 wherein a post projects upwardly on the tool and wherein the clamping device clamps onto the post.

7. A tool device in accordance with claim 1 wherein the body comprises:

an outer housing which is shaped to be gripped by the palm of the hand of the user, the tool being a flat blade planar shaped having outer serrated edges and a central projecting portion for releasable connection to the connecting device.

8. A tool device in accordance with claim 1 wherein the body comprises:

an outwardly projecting handle portion projecting from the body to be gripped by the user or to be attached to an extension handle.

9. A tool device for a detachable working tool capable of being turned to change to a different working surface or angle of attack to the work, the tool device comprising:

a body adapted to be held by the user when using the tool;

a releasable retention device in the body for retaining the tool on the body and for releasing the tool from the body;

a turning mechanism in the body allowing the tool to reposition relative to the body to change a different working surface or angle of attack;

an actuator on the body movable to a first position to actuate the turning mechanism to allow repositioning of the tool relative to the body and movable to a second position to actuate the releasable retention device for releasing the tool from the body;

a push portion on the actuator for being pushed by the user with a lighter pressure to allow turning of the tool relative to the body and being capable of being pushed with a greater pressure to cause a release of the tool from the body; and the push portion comprises a push button which is capable of being pushed with the light pressure to turn the tool through a predetermined increment of turning.

10. A tool device in accordance with claim 9 wherein the actuator portion has a portion pushing on the turning mechanism portion to turn the tool through a predetermined increment without the user touching the tool.

11. A tool device for a detachable working tool capable of being turned to change to a different working surface or angle of attack to the work, the tool device comprising:

a body adapted to be held by the user when using the tool;

a releasable retention device in the body for retaining the tool on the body and for releasing the tool from the body;

a turning mechanism in the body allowing the tool to reposition relative to the body to change a different working surface or angle of attack;

an actuator on the body movable to a first position to actuate the turning mechanism to allow repositioning of the tool relative to the body and movable to a second position to actuate the releasable retention device for releasing the tool from the body;

a push button on the actuator for being pushed by the user with a lighter pressure to allow turning of the tool relative to the body and being capable of being pushed with a greater pressure to cause a release of the tool from the body;

the body having a flat bottom surface, the tool being a flat planar blade having multiple edges for turning into a use position; and wherein the tool has a plurality of serrated edges of different sizes or spacing on the outer edges of the tool and wherein operation of the push button causes the turning of the tool to present a different serrated edge for use without the user touching the tool.

12. A tool device for use with a tool having a connecting portion thereon comprising:

a hollow body;

a retention member pivotally mounted in the hollow body;

a spring biasing the retention member to a retention position to retain the tool on the tool device;

a shoulder portion on the retention member biased by the spring to engage the connecting portion on the tool and to retain the tool on the tool device;

a turning mechanism on the tool device operable for engaging the tool and turning the tool through a predetermined increment; and an actuator for shifting the retention member to a tool release position to shift the shoulder portion from its retaining position to a release position.

13. A tool device in accordance with claim 12 comprising:

eject cam portions on the pivotally mounted retention member movable to eject the tool from the tool device.

14. A tool device in accordance with claim 12 wherein the turning mechanism comprises:

turning cam portions for engaging the tool and for turning the cam through a predetermined increment.

15. A tool device in accordance with claim 12 wherein the retention member comprises:

a plate with an enlarged opening therein to allow insertion of an enlarged head on the tool through the enlarged opening;

a wall portion of the enlarged opening on the plate to retain the tool head; and a stationary receiving portion on the tool device to receive the enlarged head when the tool is attached.

16. A combination of a tool device and a tool comprising:

a flat blade tool;

a body on the tool device releasable connected to a top side of the flat blade tool;

at least one working surface on the flat blade tool;

portions on the tool and on the tool device cooperating to turn the flat blade tool relative to the tool device to change the angle of attack to the work or to position a different working surface into use;

portions on the tool and on the tool device cooperating to releasably retain the tool on the tool device; and a push button actuator on the body operable with a first movement to turn the tool blade and operable with a second movement to release the blade tool from the body.

17. A combination in accordance with claim 16 wherein the body comprises:

the body being smaller in area than the area of the tool and being positioned centrally over the top of the blade tool and having portions thereof configured to fit within a palm and to fingers of the user.

18. A combination in accordance with claim 16 wherein the body of the tool device comprises:

a handle portion projecting outwardly on an upper side of the body.

19. A combination in accordance with claim 16 wherein the actuator is pushed with a lighter force through a predetermined distance to cause a turning of the tool blade and wherein the actuator is pushed with a larger force and through a longer distance to eject the blade tool from the body.

20. A combination in accordance with claim 16 wherein the blade tool comprises:

a substantially planar body of one piece; and an integral central post projecting upwardly from the planar body for connection to the body of the tool device.

21. A combination in accordance with claim 20 wherein the blade tool is formed with a plurality of integral teeth spaced about the upstanding post to cooperate with the tool device to turn the tool through a predetermined increment.

22. A method of using a tool having multiple working surfaces and releasably connected to a tool device having a manual handle portion, the tool being turnable about an axis through the tool; the method comprising:

providing the manual handle portion on the tool device for manipulation by the user to present a first working surface to the work;

providing a releasable and turnable tool for connection to the handle with the multiple working surfaces thereon;

moving an actuator on the tool device with a first movement to turn the tool automatically through a predetermined increment about the turning axis to present a second working surface to the work; and moving an actuator on the handle to eject with force the tool from the tool device.

23. A method in accordance with claim 22 wherein:

the ejection of the tool from the tool device comprises a pushing of the tool away from the tool device to snap off the tool from the device without the operator having to touch the tool.

24. A method in accordance with claim 22 comprising:

attaching the tool to the tool device by positioning the tool over a releasable connection on the tool and forcing or pushing the tool relative to the tool device to push on the tool into the tool device.

25. A method in accordance with claim 22 wherein the tool comprises:

a flat blade;

rotating the blade through a first increment to change the angle of attack of the blade; and rotating the blade through a second increment of turning to change the working surface to provide a different working surface in position to the work.

26. A method of using a tool having multiple working surfaces and releasably connected to a tool device having a manual handle portion; the method comprising:

providing the manual handle portion on the tool device for manipulation by the user to present a first working surface or an angle of attack on the tool to the work;

providing a releasable and turnable tool for connection to the handle with the multiple working surfaces thereon;

moving an actuator on the tool device with a first movement to turn the tool to present a second working surface or a second angle of attack to the work; and moving an actuator with a second movement to release the tool from the tool device;

providing a knob-shaped handle on the tool device for fitting in the hand of the user; and providing a push button actuator on the handle for pushing with a light force to turn the tool relative to the tool device and for pushing with a greater force to snap the tool from the tool device.

* * * * *

UNITED STATES PATENT AND TRADEMARK OFFICE

CERTIFICATE OF CORRECTION

PATENT NO. : 7,051,397 B2
APPLICATION NO. : 10/653654
DATED : May 30, 2006
INVENTOR(S) : George Smeja et al.

It is certified that error appears in the above-identified patent and that said Letters Patent is hereby corrected as shown below:

TITLE PAGE:

Column 2 (US Patent Document), Line 2 — Delete "Sidney: and insert -- Bray --; and Abstract, Section (57), Line 4 (first occurrence) — Change "fool" to -- tool --.

Signed and Sealed this

Twelfth Day of December, 2006

JON W. DUDAS
*Director of the United States Patent and Trademark Office*